United States Patent [19]

Larson

[11] 4,031,828

[45] June 28, 1977

[54] PRESSURIZED CHAFF CANISTER

[75] Inventor: Laverne J. Larson, Boxfod, Mass.

[73] Assignee: The United States of America as represented by the Secretary of the Air Force, Washington, D.C.

[22] Filed: Jan. 28, 1976

[21] Appl. No.: 653,056

[52] U.S. Cl. ..... 102/89 R; 102/63; 102/37.6; 102/89 CD

[51] Int. Cl.² ..... F42B 13/42

[58] Field of Search ..... 102/34.4, 35.6, 37.6, 102/49.4, 49.5, 63, 89; 343/18 E

[56] References Cited

UNITED STATES PATENTS

| | | | |
|---|---|---|---|
| 3,064,575 | 11/1962 | Schermaly | 102/37.6 |
| 3,095,814 | 7/1963 | Jansen et al. | 102/49.4 |
| 3,137,231 | 6/1964 | Johnson | 102/34.4 |
| 3,797,394 | 3/1974 | Thurston et al. | 102/37.6 |
| 3,837,278 | 9/1974 | Gustafsson et al. | 102/89 X |
| 3,899,975 | 8/1975 | Lawrence | 102/63 |

FOREIGN PATENTS OR APPLICATIONS

| | | | |
|---|---|---|---|
| 1,029,240 | 5/1966 | United Kingdom | 102/49.5 |

*Primary Examiner*—Verlin R. Pendegrass
*Attorney, Agent, or Firm*—Joseph E. Rusz; Henry S. Miller

[57] ABSTRACT

A self pressurizing chaff canister having a frangible enclosure containing a chaff matrix and having an end cap with a spring loaded fracture pin, and gas ports, held in a case by shear pins, the case in turn is secured in a housing by a threaded electrical squib whereupon firing of the squib will shear the pins, force the enclosure from the case while simultaneously pressurizing the enclosure, whereupon ejection of the enclosure from the case will cause the fracture pin to strike the case at which time the chaff be appropriately disbursed.

5 Claims, 3 Drawing Figures

10
12
13
14
16
18
20
22
24
26
28
30
32
34
36

PRESSURIZED CHAFF CANISTER

STATEMENT OF GOVERNMENT INTEREST

The invention described herein may be manufactured and used by or for the Government for Governmental purposes without the payment of any royalty thereon.

BACKGROUND OF THE INVENTION

This invention relates generally to pressurizing chaff canister having good blooming characteristics.

There has been a number of theories on how to best dispense chaff into the atmosphere for the purpose of acting as an effective tactical countermeasure weapon. One of the more difficult obstacles to overcome is the "birdnesting" effect that occurs when a package of dipole chaff is released into the airstream of a fast flying aircraft. Air acting upon the dipoles tends to cause them to maintain their packaged form, even after the package has been removed.

A number of attempts have been made to eliminate this problem and although advances have been made, none thus far known will dispense and disburse the chaff with efficiency approaching maximum.

Pressurization techniques have been utilized in the past; however, rupturization of the container achieves less than an ideal chaff bloom. In addition, known pressurization methods involve pressurization of the chaff dispenser during manufacture. These methods require construction of the dispenser in such a manner as to maintain pressure for the reasonable lifetime of the dispenser. Alternatively, pressure for the dispenser may be derived from some onboard aircraft pressurization system thereby increasing weight and adding further complicated systems to the aircraft.

SUMMARY OF THE INVENTION

The invention herein presented involves a chaff dispenser of a frangible material that is self pressurized at the moment of ejection from the aircraft.

Utilizing an electric squib for ejection of the chaff containing case, the invention provides shear pins to restrain movement of the case until a predetermined pressure is achieved within the case. Upon reaching the critical pressure, the shearing pins break releasing the case from its housing.

A bore riding spring biased fracture pin carried within the inner end cap of the frangible chaff case is released as the case is expelled from the housing. The fracture pin strikes the case instantaneously, completely destroying the case and scattering the chaff in a near perfect cloud pattern.

It is therefore an object of the invention to provide a new and improved pressurized chaff canister.

It is another object of the invention to provide a new and improved pressurized chaff canister that is self pressurized at the moment of ejection.

It is a further object of the invention to provide a new and improved pressurized chaff canister that is simple in design.

It is still another object of the invention to provide a new and improved pressurized chaff canister that has a long shelf life and requires no maintenance.

It is still a further object of the invention to provide a new and improved pressurized chaff canister that provides a more efficient chaff cloud pattern than any similar hitherto known device.

It is another object of the invention to provide a new and improved pressurized chaff canister that is low in cost and utilizes readily obtainable parts and pieces.

It is another object of the invention to provide a new and improved pressurized chaff canister that is highly reliable.

It is another object of the invention to provide a new and improved pressurized canister that may be ejected from an aircraft for dispensing any suitably sized material in a uniform and controlled manner.

These and other advantages, features and objects of the invention will become more apparent from the following description taken in connection with the illustrative embodiment in the accompanying drawing.

DESCRIPTION OF THE PREFERRED EMBODIMENT

Figures 1, 2, 3:
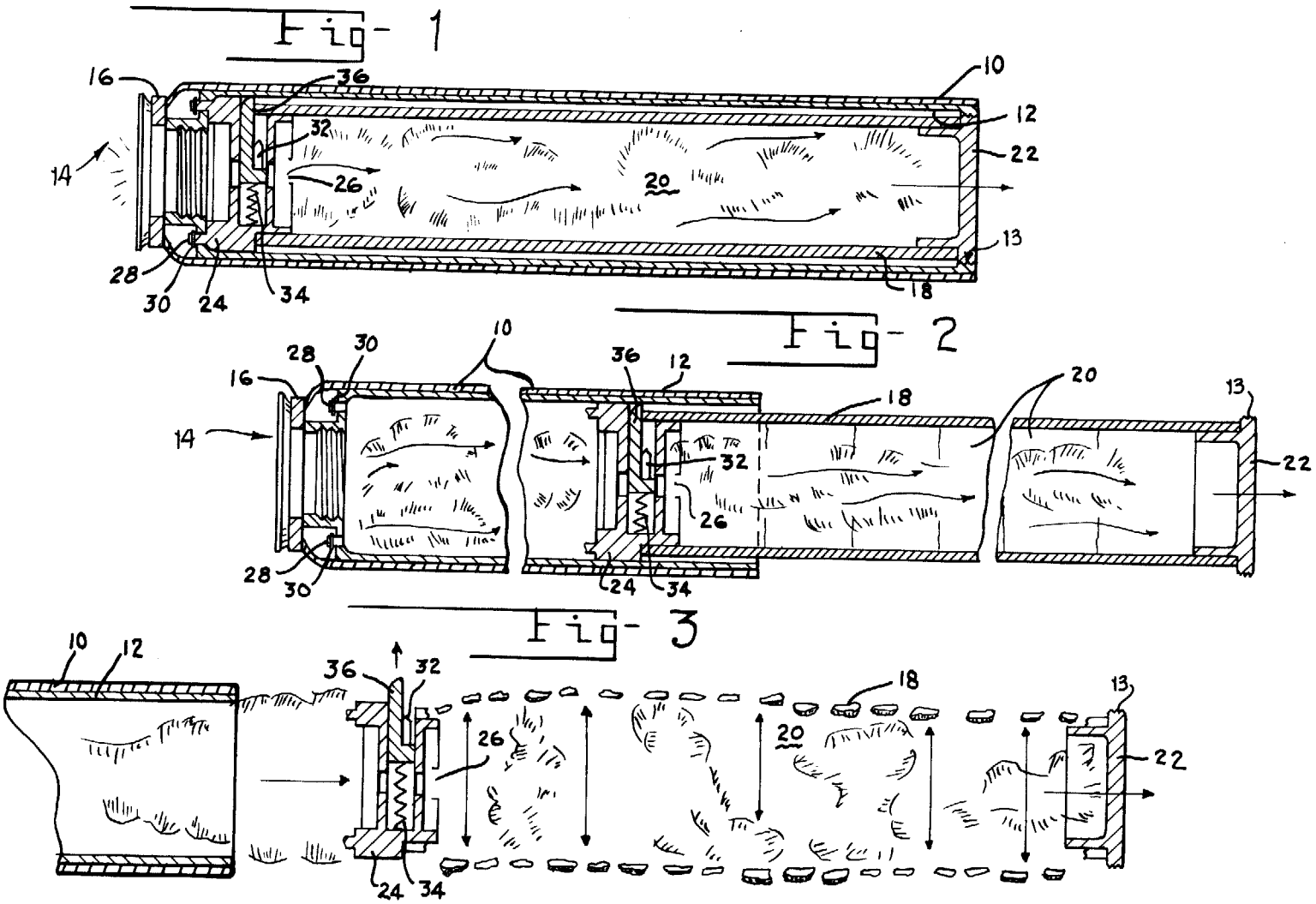
FIG. 1 is a side elevation view of the invention at the instant of firing, partly in section.
FIG. 2 is a side elevation view of the invention as the case is leaving the housing, partly in section.
FIG. 3 is a side elevation view of the invention after the case has left the housing and is breaking up, partly in section.

Referring now to FIG. 1, the invention comprises a housing 10 of metal or other suitable material. Within the housing is a plastic liner 12 held by the threaded electrical squib shown generally at 14 which is separated from housing 10 by ring spacer 16. Frangible tempered glass case 18 contains a chaff matrix 20 and is sealed by the outer end cap 22. Outer end cap 22 is adapted to be held by plastic liner 12 when in the stored condition by means of an interrupted thread 13 requiring a quarter turn or less for disengagement.

Inner end cap 24 is adapted to ride along the plastic liner 12 and is provided with at least one shaped aperture 26 to allow gas emanating at the squib 14 to enter the case 18. Shear pins 28 extending from inner end cap 24 pass through plastic liner 12 and are secured with push nuts 30 whereby said shear pins must be broken by a predetermined force before the case will move.

Additionally, inner end cap 24 contains a spring biased bore riding fracture pin 32 including spring 34 and bore riding member 26.

In operation, upon firing of the electric squib 14, gas enters the case 18 through opening 26 so shaped as to allow the gas to enter more rapidly than it exits, upon a reduction in pressure. When the gas pressure reaches a selected point (approximately 100 psi) shear pins 28 break and case 18 moves out of housing 10 as shown in FIG. 2.

Immediately upon leaving the housing, the restraining force is removed from the bore riding member 36, allowing fracture pin 32, driven by spring 34, to strike the frangible glass case 18 causing it to destroy itself as shown in FIG. 3. Force from gas within the case causes the chaff to disburse equally in all directions thereby creating a near perfect chaff cloud pattern.

Although the invention has been described with reference to a particular embodiment, it will be understood to those skilled in the art that the invention is capable of a variety of alternative embodiments within the spirit and scope of the appended claims.

What is claimed is:

1. A self pressurized chaff canister comprising: a housing; lining means witin the housing; case means having open ends movably positioned within the lining means; first and second end cap means adapted to cover the ends of said case means, and electric squib means for generating a gas to fill said case means and move said case within the housing.

2. A self pressurized chaff canister according to claim 1 wherein said case means is formed of frangible glass.

3. A self pressurized chaff canister according to claim 2 wherein said first end cap includes shear pin means adapted to secured said liner and restrain the case from movement.

4. A self pressurized chaff canister according to claim 3 wherein said first end cap includes a spring biased fracture pin adapted to strike said case when said case is no longer within said liner.

5. A self pressurized chaff canister according to claim 4 wherein said first end cap further includes shaped openings whereby gas entering said case means will be impeded from leaving said case means.

* * * * *